United States Patent [19]

Goldfarb et al.

[11] 4,192,092

[45] Mar. 11, 1980

[54] TOY EATING ANIMAL UTILIZING CONVEYOR

[75] Inventors: Adolph E. Goldfarb, 4614 Monarca Dr., Tarzana, Calif. 91356; Erwin Benkoe, deceased, late of Encino, Calif.; by Elisabeth Benkoe, Executrix, 17965 Medley Dr., Encino, Calif. 91316; Elonne Dantzer, Redondo Beach, Calif.

[73] Assignees: Adolph E. Goldfarb; Elisabeth Benkoe, Executrix for Estate of Erwin Benkoe, both of Northridge, Calif.

[21] Appl. No.: 876,657

[22] Filed: Feb. 10, 1978

[51] Int. Cl.[2] ..... A63H 13/02

[52] U.S. Cl. ..... 46/123; 46/141

[58] Field of Search ..... 46/141, 123, 4, 5

[56] References Cited

U.S. PATENT DOCUMENTS

| | | | |
|---|---|---|---|
| 843,024 | 2/1907 | Livingston | 46/141 |
| 2,631,408 | 3/1953 | Henry | 46/141 |
| 2,802,301 | 8/1957 | Lohr | 46/123 |
| 3,197,918 | 8/1965 | Coggeshall | 46/141 X |

FOREIGN PATENT DOCUMENTS

| | | | |
|---|---|---|---|
| 263377 | 8/1913 | Fed. Rep. of Germany | 46/141 |
| 474020 | 4/1929 | Fed. Rep. of Germany | 46/123 |
| 921344 | 3/1963 | United Kingdom | 46/141 |

*Primary Examiner*—F. Barry Shay

*Attorney, Agent, or Firm*—Robert M. Ashen; Robert J. Schaap

[57] ABSTRACT

A three-dimensional toy representation of a figure such as an animal, e.g. a goat, which includes an outer body and a head pivotally mounted on the body which may be manually shifted between an upright and a lower position. The head includes an opening representative of a mouth and a conveyer mechanism inside the body extends into the head and has a portion located close to the mouth opening. Articles representative of solid or relatively solid "food," such as carrots, tin cans, etc., can be introduced into the mouth. The articles may be physically grasped by the conveyer mechanism and moved into an interior compartment. A portion of the path of movement of the articles may be upward or partially upward. The conveyer mechanism can be operated by manually actuating a portion of the animal figure, such as reciprocatively shifting a tail thereon. A lower jaw on the animal figure may be caused by the conveyer mechanism to move up and down to represent a chewing action when the food articles are introduced into the mouth and while they are being moved by the conveyer mechanism. A removable access member on the side of the animal, representative of a side-pack, can be removed so that the child-user can retrieve the solid food articles.

5 Claims, 10 Drawing Figures

TOY EATING ANIMAL UTILIZING CONVEYOR

BACKGROUND OF THE INVENTION

1. Field of the Invention

This invention relates in general to certain new and useful improvements in toy figures which are capable of taking in articles representative of play food so as to represent an eating of the play food articles.

2. Brief Description of the Prior Art

There is a prior art toy apparatus including a plurality of buckets located on a conveyor line and in which a child-user introduces sand or similar substances into the buckets and which are dumped when the buckets reach an end of a conveyor line.

There are also many prior art dolls in which a liquid, such as water, can be introduced into a mouth opening on the head of the doll and in which the doll discharges the liquid in a representation of urinating. These so-called "urinating" dolls did not hold the liquid for later discharge; the liquid merely flowing through the doll from a mouth opening to and through a discharge opening.

There has also been a toy figure representative of a chicken and in which a child-user placed objects, such as toy eggs, within the chicken. When the child-user pushes on the chicken, or otherwise exerts pressure on the chicken, the eggs will pass out of the chicken.

There has also been a prior art doll representative of a baby in which a substance representative of food was introduced into a mouth opening on the doll. This substance was then discharged from the doll into a disposable diaper, representative of an excreting of the food substance by the doll. The food substance had a farily thin consistency, that is, it had a viscosity similar to or not substantially greater than water, so that it passed through the doll much in the same manner as water. This so-called "eating" doll operated much in the same manner as the urinating dolls in that the food substance was a liquid and merely passed through the doll from the mouth opening to a discharge opening. Furthermore, the food substance did not remain in the doll for any period of time, except for the time to flow through the doll. Moreover, a jaw portion on the head of this doll also shifted up and down to depict a chewing action when the food substance was introduced at a mouth opening. A battery operated motor caused the shifting action of the jaw portion. However, the jaw action was merely an amusement feature and was not operable with any portion of the food substance flow system.

The present invention provides a toy animal figure which is capable of taking solid or relatively solid play food articles when introduced at the mouth opening, conveying the food articles to an interior portion of the animal figure and storing the food articles until later removed by a child user. Thus, the toy animal figure of this invention provides a fairly realistic representation of the animal figure eating the food articles.

OBJECTS OF THE INVENTION

It is, therefore, a primary object of the present invention to provide a toy animal figure which is capable of taking in articles representative of play food to depict an eating action by the animal figure and in which the play food articles can be subsequently retrieved.

It is another object of the present invention to provide a toy animal figure of the type stated which includes a conveyer mechanism extending into a mouth portion on the animal figure for carrying the play food articles introduced at a mouth opening on the animal figure to an interior compartment in the body of the animal figure.

It is also an object of the present invention to provide a toy animal figure of the type stated in which the play food articles can be grasped by the conveyer system and when introduced at the mouth portion of the figure and where the conveyer system is capable of moving the articles in a path which is at least partially upward.

It is a further object of the present invention to provide a toy animal figure of the type stated which includes a movable jaw portion on the head of the toy animal figure and which shifts in relationship to the head while the play food articles are introduced into the mouth opening providing a representation of a chewing action.

It is an additional object of the present invention to provide a toy animal figure which can be constructed at a relatively low cost and which is highly durable in its construction.

It is also an object of the present invention to provide a toy animal figure of the type stated which can adopt the characterization of various animal forms and which can be constructed in a wide variety of sizes and shapes and operable to represent the eating of solid or relatively solid play food articles.

With the above and other objects in view, our invention resides in the novel features of form, construction, arrangement and combination of parts presently described and pointed out in the claims.

SUMMARY OF THE DISCLOSURE

A toy animal figure comprising an outer body having an interior chamber and with a head pivotally mounted on the forward end of the body. In one embodiment of the invention the head is capable of being shifted from an upper position to a lower, or to any position intermediate the upper and lower positions. The head is provided with a forwardly projecting upper jaw and a forwardly projecting lower jaw. These jaws form a mouth opening for receiving solid or relatively solid play foods.

A conveyer system in the body and head of the animal figure will cause the movement of the play food articles from the mouth opening to the interior chamber where the food articles can be held or stored for later removal by a child user. A portion of the animal figure could be actuable to cause operation of the conveyer system. In a preferred embodiment, a reciprocally shiftable tail is also mounted on the body of the toy animal figure and can be manually shifted by the child user in order to operate the conveyer system. Means connected to the conveyer system can also cause the shiftable movement of one of the jaws, e.g. the lower jaw, during the intake of the solid or relatively solid play food articles in a manner to be hereinafter described.

It should be understood that the conveyer system could be operated by another device which provides a source of power. Thus, for example, a motor, e.g. a spring wind-up motor or battery operated motor could be used to operate the conveyer system. Moreover, the battery operated motor or other motor could be automatically energized by a switch which is actuated when a play food article is introduced into the mouth opening.

In the embodiment as illustrated, the toy animal figure has the characterization of a goat, although it should be understood that other animal figures, as for example, cows, horses, or the like, could be employed. The animal figure could also include representations of toy human beings. The animal figure could further include representations of other life forms, such as fish, birds, enlarged representations of toy insects and the like. The animal figures would also include robots and similar objects characterized with a life-like form. Animated characterizations of inanimate objects, such as mountains, trees and the like, could be represented as eating an object as well. Thus, the term "animal figure" is used in a broad sense to include any form of animate object or any inanimate object which is or can be animated or object characterization which a child perceives as eating. However, inanimate objects may not have a head section in the same form as an animal, for example. Therefore, the head section of an animal figure, as used herein, shall include that portion of the object which includes the mouth opening.

The articles which are representative of play food are solid or relatively solid. Thus, the terms solid or relatively solid shall means any article representative of a play food which has a consistency substantially greater than water and which has some physical body to it. However, the play food articles could be somewhat flexible, as for example, with a sponge-like consistency, or they could be foldable in the manner of a piece of coth, or they could be highly elastic as with a putty-like consistency. Thus, the food articles are solid or relatively solid in the sense that they do not flow in the same manner as a liquid. In addition, the play food articles do not have to represent edible foods as such. Thus, the play food articles are essentially any object capable of being taken in by an animal, fish, bird or insect, or for that matter, objects capable of being taken in by an inanimate member which is animated. For example, an animated mountain could "eat" rocks or the like. Thus, the toy food articles of the present invention may encompass any type of solid or relatively solid element.

When a play food article is introduced at the mouth opening on the head of the animal figure, it will be taken in by the conveyer system which extends in a close proximity to the mouth opening and into the interior chamber where the play food article will be dropped into the interior chamber. The play food articles are capable of being taken in by the animal figure when the head is in either the upper position or the lower position or any position intermediate therebetween. Thus, the food articles are capable of being delivered from the mouth opening into the interior chamber of the animal figure where a portion of the path of movement of the food article may be upward or partially upward. In addition, the conveyer system is designed so that the food article can be grasped when introduced into the mouth opening. Thus, the child user only has to introduce the food article at the mouth opening and the animal figure will grasp, take in the food article and deliver it to the interior chamber.

In addition, the mechanism which causes a reciprocatively shiftable movement of one of the jaws, e.g., the lower jaw, is a star wheel mechanism operatively connected to the conveyer system, and this movement represents a chewing action of the animal figure while the play food articles are being introduced and conveyed to the interior chamber. In this way, the animal figure provides a realistic characterization of eating the food article.

The conveyor system includes a continuous conveyer belt which may be trained around various pulleys or wheels or gears within the animal body and head and provides a desired path of movement. One portion of the conveyor belt extends toward the mouth opening and engages the food article introduced at the mouth opening against a solid portion of the mouth to convey the food article into the interior chamber. The conveyer belt may be operated, as for example, by shifting the tail of the animal figure as aforesaid. Thus, the tail is operatively connected to a ratchet wheel which is operatively engaged with a gear or wheel which moves the conveyer belt. A means to compensate for the size of the play food article which is introduced at the mouth opening may be provided.

It should be understood also that a plurality of conveyor belts could be used in place of one belt and which may be operatively connected so that they are movable together. In this respect, the term conveyer is used in a broad sense in that it does not have to be in the form of a continuous conveyer belt or a plurality of conveyer belts. Thus, the conveyer system could comprise a rack bar which is shifted back and forth to engage and move the food articles from the mouth opening to the interior chamber. While the use of the conveyer belt or belts is the preferred form of conveyer system, any mechanically shiftable member which is effective to move the food articles from the mouth opening to the interior chamber may be used as the conveyer system.

The animal figure is provided with an access opening on the body with an openable and closable cover portion so that the child user may open the cover portion to remove the play food articles. In a preferred embodiment, the cover portion may adopt the form of a sidepack on the animal figure and which is hingedly mounted on the animal body to be opened and closed.

BRIEF DESCRIPTION OF THE DRAWINGS

Figure 1:
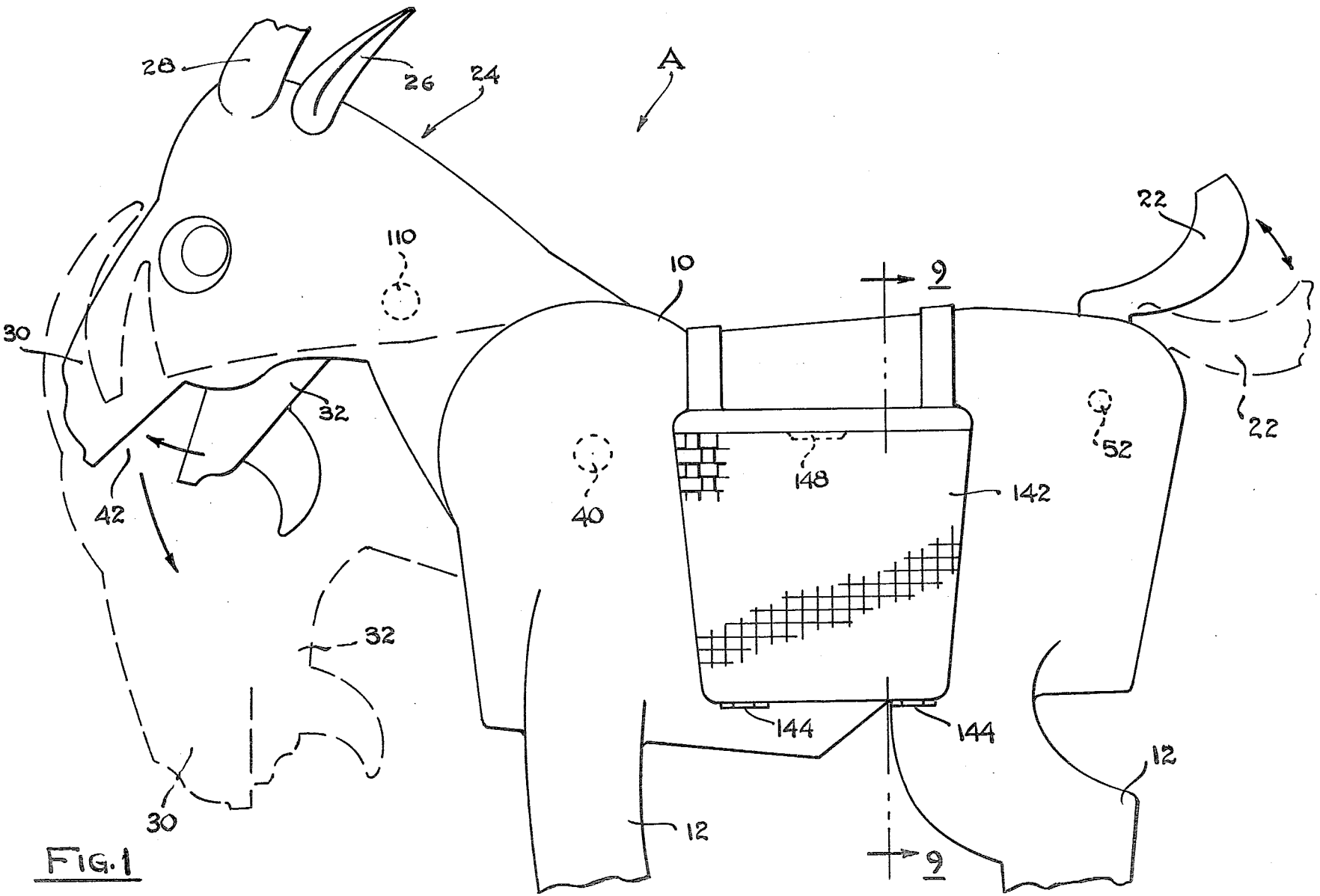
Figure 2:
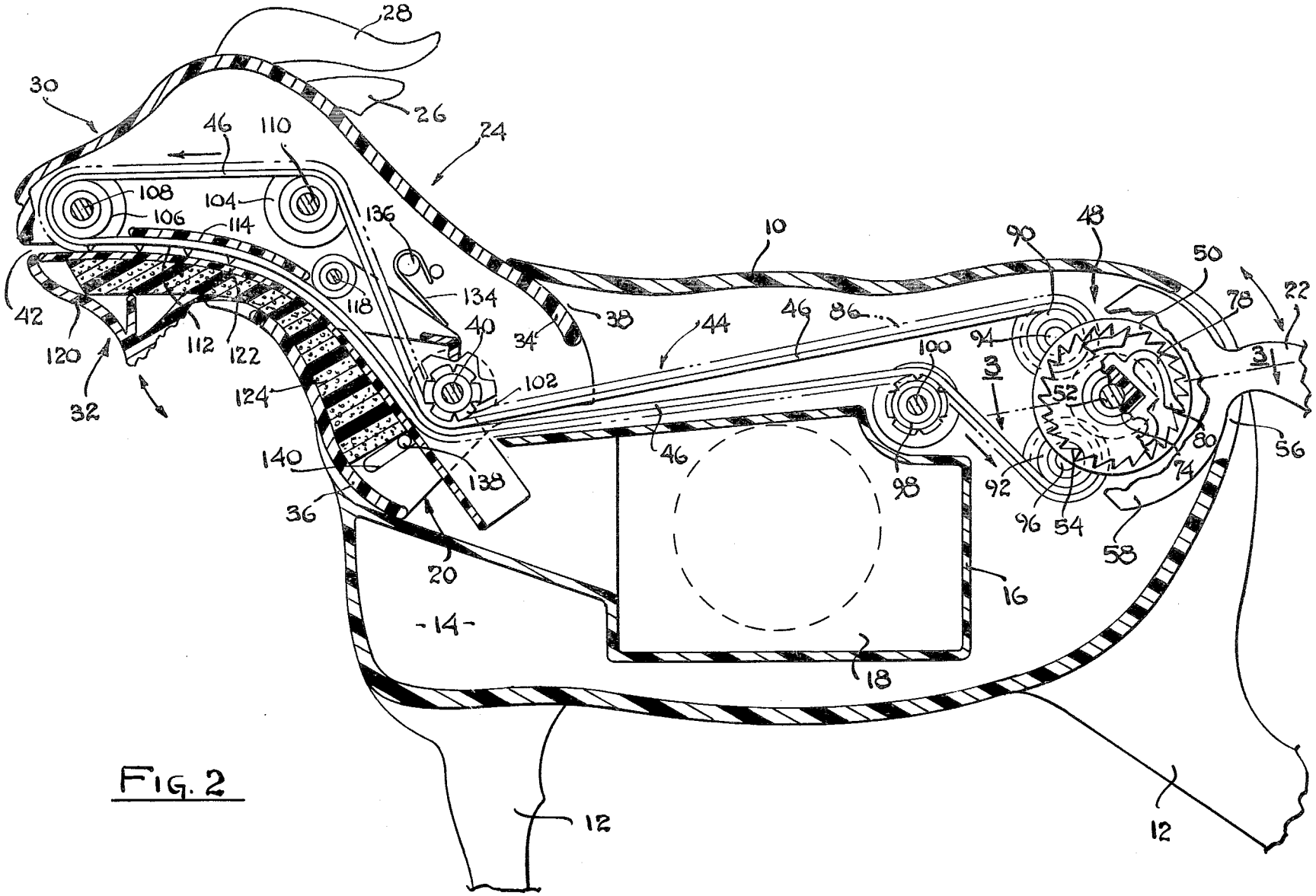
Figure 3:
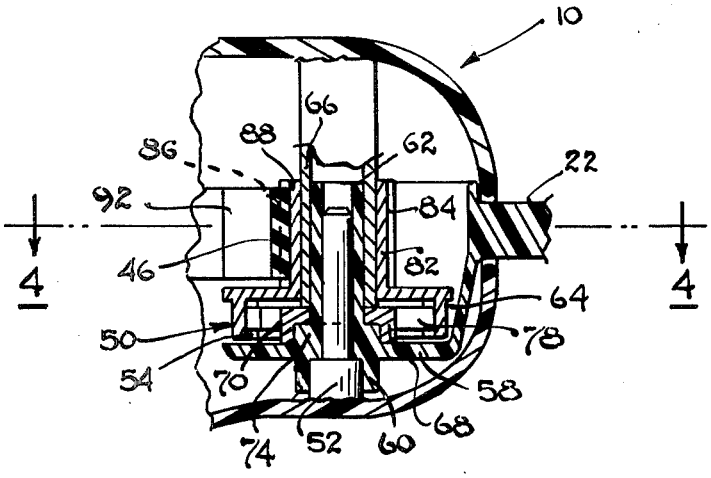
Figure 5:
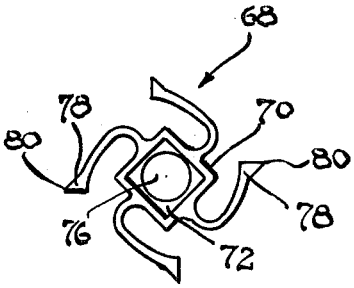
Figure 10:
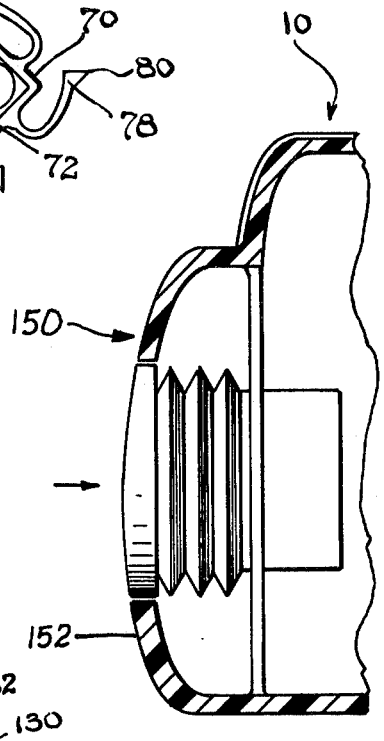
Figure 8:
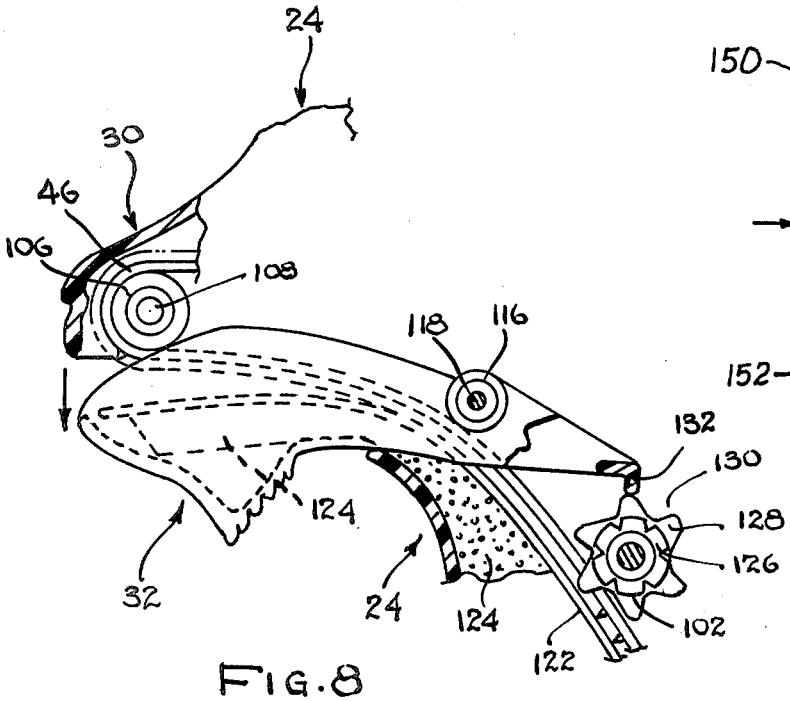
Figure 7:
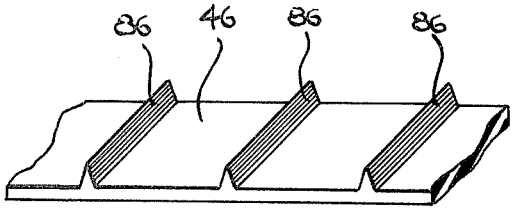
Figure 9:
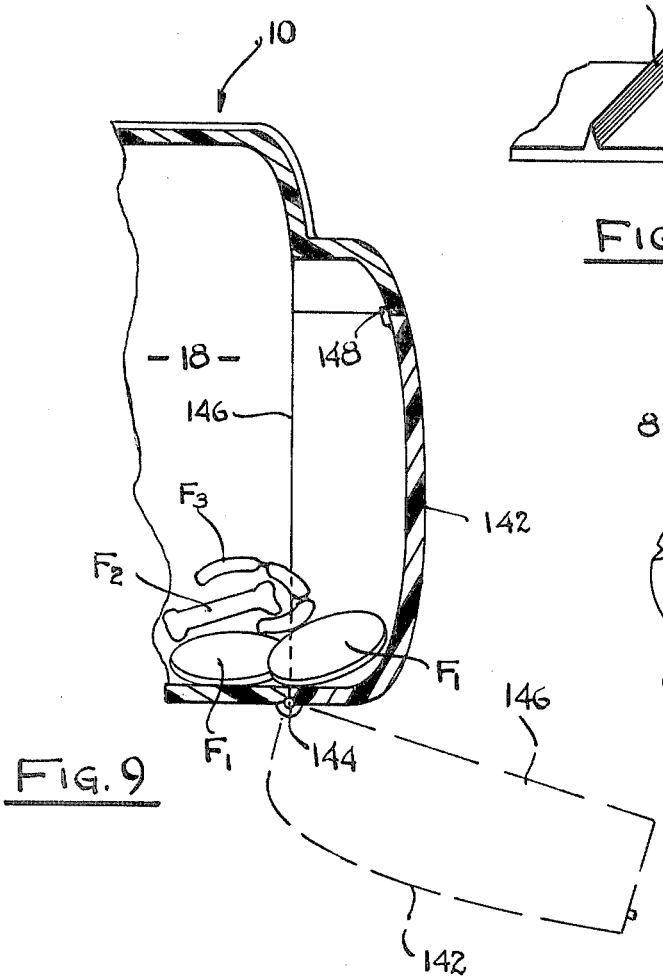
Figure 6:
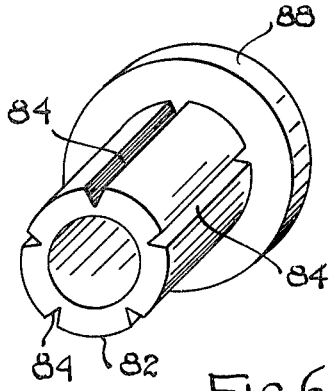
Figure 4:
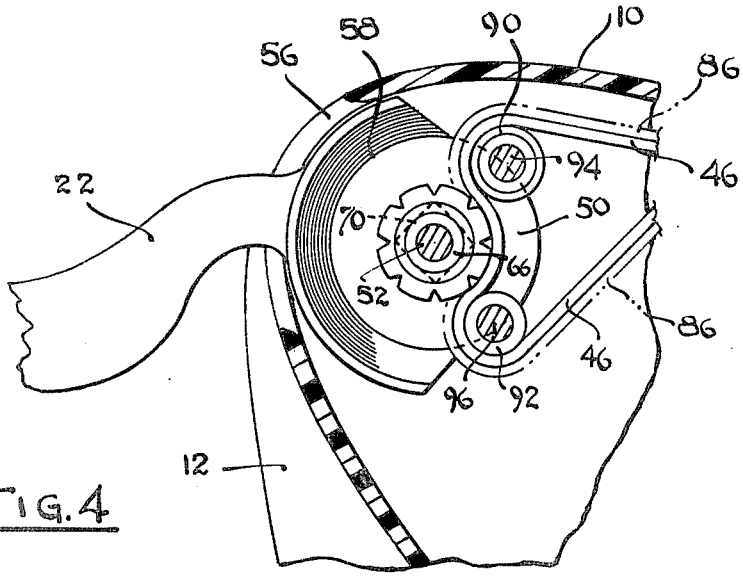

Having thus described the invention in general terms, reference will now be made to the accompanying drawings in which:

FIG. 1 is a side-elevational view, partially shown in phantom lines, of a toy animal figure apparatus constructed in accordance with and embodying the present invention;

FIG. 2 is a vertical sectional view of the toy animal figure apparatus of FIG. 1 and showing the conveyer system forming a part thereof;

FIG. 3 is a fragmentary somewhat horizontal sectional view taken along line 3—3 of FIG. 2, and showing a portion of a drive mechanism forming part of the apparatus of the present invention;

FIG. 4 is an enlarged fragmentary vertical sectional view taken along line 4—4 of FIG. 3;

FIG. 5 is a side elevational view of a ratchet member forming part of the drive mechanism of FIGS. 3 and 4;

FIG. 6 is a perspective view of a drive wheel forming part of the drive mechanism of FIGS. 3 and 4;

FIG. 7 is a fragmentary perspective view showing a portion of a conveyer belt forming part of the conveyer system of the present invention;

FIG. 8 is a fragmentary side elevational view, partially in section, and showing a portion of the jaw shifting mechanism forming part of the toy animal figure apparatus;

FIG. 9 is a fragmentary vertical sectional view taken along line 9—9 of FIG. 1 and showing a portion of the access means to the interior chamber of the toy animal figure apparatus; and FIG. 10 is a vertical sectional view showing a sound generating mechanism forming part of the toy animal figure apparatus.

DETAILED DESCRIPTION OF A PREFERRED EMBODIMENT

Referring now in more detail and by reference characters to the drawings which illustrate a preferred embodiment of the present invention. A designates a toy animal figure in the form of a goat, and which includes an outer body 10 representative of the torso section of the animal. Integrally formed with and depending from the body 10 are four legs 12 which may be provided with extensions representative of feet (not shown) for engagement with a table or floor or supporting surface.

The body 10 may be formed of a pair of opposed shells which are capable of being secured together, either by means of a snap-fitted attachment or by screws or the like. The body 10 is preferably hollow to form an interior chamber 14 with a plurality of rectangularly located walls 16 forming a toy food article receiving chamber. The walls 16 form an opening 20 at the forward end to receive toy food articles, in a manner to be hereinafter described in more detail.

Pivotally mounted on the rearward end of the body 10 is a tail 22 which is capable of being reciprocatively shifted from an upper position, as shown in the solid lines of FIG. 1, to a lower portion, as shown in the phantom lines of FIG. 1. This reciprocative action will cause the animal figure apparatus to take in food articles in a manner to be hereinafter described in more detail.

Pivotally mounted on the forward end of the body 10 is a head section 24, which is also capable of being shifted from an upper position, as illustrated in the solid lines of FIG. 1, to a lower position, as illustrated in the phantom lines of FIG. 1, and back to its upper position or to any intermediate position therebetween. The head may suitably be provided with extensions 26 representative of ears and extensions 28 representative of horns and is also characterized to represent a goat's head. The head section 18 includes a forwardly extending upper jaw portion 30 which protrudes generally forwardly and a lower jaw portion 32 which is pivotally mounted on the head section 24 in a manner to be hereinafter described in more detail.

The head section 24 includes upper and lower rearwardly extending wall portions 34 and 36, respectively, which extend into a socket 38 formed at the forward end of the animal figure 10. In addition, the head section 24 is pivotally mounted on the animal body 10 by means of a transversely extending pivot pin 40. The child user can shift the animal head section 24 either to the upper position or the lower position as illustrated in FIG. 1, or to any intermediate position therebetween. In this way, the child user can cause the animal figure apparatus to "eat" the toy food articles, as hereinafter described, in any of the desired positions.

The toy food articles are preferably solid or relatively solid as described above, and can adopt any of a variety of shapes and sizes as hereinabove described. The toy food articles are only limited in size to fit within a mouth opening 42 formed between the upper jaw portion 30 and the lower jaw portion 32 and to be carried or moved by the conveyor system to be hereinafter described. A few of the toy food articles are illustrated in FIG. 9 and include, for example, a pair of discs $FG_1$ a bone $F_2$ and a portion of a chain $F_3$.

The toy animal apparatus includes a conveyer system 44 for delivering the food articles from the mouth opening 42 to the toy food article receiving chamber 18. The conveyer system 44 generally comprises a continuous conveyer belt 46 which is operated by a drive section 48 located at the rearward end of the body 10 and which drive system 48 is more fully illustrated in FIGS. 2–6 of the drawings. The drive system 48 generally comprises a ratchet wheel 50 which is rotatably mounted within the rearward portion of the body 10 by means of a transversely extending pivot pin 52. The pin 52 can be suitably attached to or journaled in one or both of the shells forming part of the toy animal body 10. The ratchet wheel 50 is provided with a plurality of interiorly presented gear teeth 54, in the manner as illustrated in FIG. 2 of the drawings.

The tail is shiftable within an elongate slot 56 (reference being made to FIG. 4) at the rearward end of the animal body and includes at its inner end, a somewhat cup-shaped member 58. By reference to FIGS. 3 and 4 of the drawings, it can be observed that the somewhat cup-shaped member 58 includes a boss 60 to accommodate one end of the pivot pin 52. In addition, the cup-shaped member 58 includes a transversely extending sleeve 62 which is concentrically disposed about a portion of the pivot pin 52. The ratchet wheel 50 includes an annular projection 64 which contains the interiorly presented gear teeth 54. Moreover, the ratchet wheel 50 is concentrically disposed over a sleeve 66 which is, in turn, disposed about the pivot pin 52 so as to permit free rotation of the ratchet wheel 50.

A pawl 68, which is more fully illustrated in FIG. 5 of the drawings, includes a plate 70 having a rectangularly shaped recess 72 which fits over a rectangularly shaped projecting 74 on the cup-shaped member 58. In addition, the pawl 68 includes an aperture 76 which is capable of accommodating the pivot pin 52. In addition, the pawl 68 is provided with a plurality (four as shown) of outwardly projecting fingers 78 having prongs 80 at the outer end which engage the recesses between each of the gear teeth 54 on the ratchet wheel 50. In this way, it can be observed that as the child user shifts the tail 22 up and down, the shiftable movement thereof will cause an arcuate movement of the cup-shaped portion 58. This arcuate movement of the cup-shaped portion 58 will thereupon cause the pawl 68 to shift back and forth in an arcuate path. As this occurs, the prongs 80 on the fingers 78 will engage the recesses between the teeth 54 on the ratchet 50, thereby causing rotation of the same in the clockwise direction, reference being made to FIG. 2 of the drawings. Moreover, it can be observed that the prongs 80 are shaped so that they will be easily removable from the recesses between the teeth 54 when the tail is shifted upwardly. Thereafter, as the tail 22 is again shifted downwardly, the prongs 80 will engage the recesses between the teeth 54, thereby causing the ratchet wheel 50 to rotate in the clockwise direction.

A drive roller 82 is integrally formed with the ratchet wheel 50 and extends inwardly therefrom in the manner as illustrated in FIG. 3 of the drawings. The drive roller 82 includes a plurality of circumferentially spaced apart grooves 84 on its exterior face for engaging a plurality of outwardly extending somewhat inverted V-shaped or triangularly shaped projections 86 on the drive belt 46, in the manner as illustrated in FIGS. 6 and 7 of the drawings. Thus, the drive roller 82 could be considered to be a gear having a plurality of gear teeth on its exterior face. At its intermost end, the drive roller 82 is provided with an enlarged flange 88 in order to retain the continuous conveyer belt 46 on the drive roller 82, as also illustrated in FIGS. 3 and 6 of the drawings. Thus, it can be observed that as the tail 22 is shifted upwardly and downwardly within the elongate slot 56, it will cause rotation of the ratchet 50 in the manner as previously described. Consequently, the drive roller 82 which is integral with the ratchet wheel 50 will also rotate in the clockwise direction, reference being made to FIG. 2. The rotation of the drive roller 82 will cause the conveyer belt 46 to also move, but in the counterclockwise direction, reference being made to FIG. 2 of the drawings.

By reference to FIG. 4, it can be observed that the conveyer belt 46 is trained about a pair of vertically spaced apart idler rollers 90 and 92 and which are respectively mounted on pins 94 and 96 generally within one or both of the shells of the body 10. In this way, the idler rollers 90 and 92 will urge the conveyer belt 46 into contact with the drive roller 82.

The conveyer belt 46 extends forwardly in the animal body 10, reference being made to FIG. 2, and the lower portion thereof is again trained about an idler roller 98 which is similarly mounted on a pin 100, which is again journaled within the animal body. This latter idler roller 98 will also be provided with a plurality of grooves on its exterior surface, similar to the drive roller 82 in order to accommodate the V-shaped prongs 86 on the conveyer belt 46. As the conveyer belt 46 extends into the head section 24, it is trained about another roller 102, which is mounted on the pin 40 and which roller 102 is similarly provided with a plurality of V-shaped grooves similar to the grooves 84 on its exterior face in order to accommodate the prongs 86 on the exterior surface of the conveyer belt 46. Finally, the upper portion of the conveyer belt 46 is trained about a pair of idler rollers 104 and 106, in the manner as illustrated in FIG. 2 of the drawings. Here, again, the idler rollers 104 wand 106 are similarly mounted on pins 108 and 110, respctively, which are again journaled within the head section 24.

It can be observed that as the conveyer belt 46 rotates in the head section, it will be located within a channel 112 leading into the mouth opening 42. Moreover, the lower portion of the conveyer belt 46 defines the upper portion of the channel 112 and is retained in position by means of a backing plate 114.

The lower jaw section 32 is pivotally mounted with respect to the remaining portion of the head section 24 on a pivot pin 116 in the manner as illustrated in FIGS. 2 and 8 of the drawings, and which is again retained on a pin 118 suitably journaled within the head section 24. Thus, the lower jaw portion 32 can shift upwardly and downwardly independently of any raising and lowering movement of the head section 24. The jaw portion 32 includes an outer shell 120 and an interior somewhat flexible plate 122 which serves as a tongue and which also defines a portion of the channel 112. It can be observed that the tongue 122 extends inwardly through the head section 24 and into the body 10 and terminates at a point where it leads into the receiving chamber 18. The tongue 122 is disposed against a somewhat resilient pad 124 also formed within a portion of the lower jaw 32 and the head section 24, in the manner as illustrated in FIG. 2 of the drawings. This somewhat flexible tongue 122, along with the resilient pad 124, are sufficiently resilient so that they can be compressed in order to accomodate a toy food article passing through the channel 112.

A star wheel 126 is also mounted for rotation with the idler roller 102 in the manner as illustrated in FIGS. 2 and 8 of the drawings. The star wheel 126 includes a plurality of circumferentially spaced outwardly extending projections 128 separated by circumferentially spaced apart recesses 130. The shell 120 of the lower jaw portion 32 is provided with a finger 132 at its rearward end and which is capable of being intermittently contacted by the projections 128 on the star wheel 126. It can be observed that as the conveyor belt 46 moves in a generally counterclockwise direction, reference being made to FIG. 2, the idler roller 102 will be rotated in a clockwise direction. As this occurs, the star wheel 126 will similarly be rotated in a clockwise direction. Rotation of the star wheel 126 will cause the finger 132 on the rearward end of the lower jar portion 32 to be intermittently engaged by the projections 128. As this occurs, the jaw portion 32 will continue to shift up and down. Thus, as the finger 132 engages a projection 128 on the star wheel 126, the lower jaw portion 32 will be biased downwardly. In like manner, continued rotation of the star wheel 126 will cause the finger 132 to move into one of the recesses 130 thereby permitting an upward movement of the jaw 32. In this respect, it can be observed that a torque spring 134 and which is mounted upon a pin 136 in the head section 24 will bear against the shell 120 of the lower jaw portion 32. In this way, the torque spring 134 will always bias the lower jaw portion 32 to the upper position as illustrated in FIG. 2 of the drawings. However, when the finger 132 is moved into one of the recesses 130, the lower jaw portion 32 will be urged downwardly against the action of the torque spring 134. In this way, it can be observed that the rotation of the conveyer belt 46 will also give rise to a shiftable movement of the lower jaw portion 32. Thus, as food is introduced into the mouth opening 42 and into the channel 112, the lower jaw portion 32 will shift upwardly and downwardly to represent a chewing action.

When using the toy animal figure apparatus, the child user will actuate the tail 22 by shifting the same in an upward and downward direction. Each upward movement of the tail 22 locates the cup-shaped section in a position where a downward stroke will cause rotation of the ratchet wheel 50. As the child-user pushes down on the tail 22, the ratchet wheel 50 will rotate in the manner as previously described. As this occurs, the drive roller 82 will rotate and give rise to the movement of the continuous conveyor belt 46. Moreover, the lower jaw portion 32 will start the "chewing action" by shifting upwardly and downwardly in a continuous pattern with respect to the head section 24. The child-user may then introduce any of the toy food articles into the mouth opening 42 where they will be moved into the channel 112. It can be observed that as the toy food article is introduced into the mouth opening 42, it will be engaged by one or more of the projections 86 on the continuous conveyor belt 46. Thus, the food article will be moved along the tongue 122 and in and through the opening 20 into the article receiving chamber 18. It can also be observed that the tongue 122 and the flexible material 124 will yield in order to account for the size and shape of the toy food article. In this respect, it can be observed that the lower end of the tongue 122 is provided with a guide pin 138 which moves within an elongate slot 140 formed within the head section 24. In this way, the lower portion of the plate representative of the tongue 122 will yield to the toy food article and shift back to its initial position after the passage of the toy food article.

As indicated previously, the head section 24 can be located in either the upper position or the lower position or in any position intermediate therebetween. Thus, the child-user can locate the animal figure apparatus head section 24 in the desired position. In this respect, it can be observed that if the head section 24 shifted to the lower or one of the lowermost positions, a portion of the path of movement of the toy food article will be somewhat upwardly. Thus, it can be observed that the toy food articles will be taken in and continuously moved along by the conveyor belt 46 regardless of the direction of movement, so that it is ultimately introduced into the article receiving chamber 18.

The animal body 10 is provided on its exterior surface with a hinged panel 142, representative of a side pack, by means of a hinge 144, as illustrated in FIGS. 1 and 9 of the drawings. The panel 142 permits access through an opening 146 in the body 10 leading into the article receiving chamber 18. In this way, the child-user can pivot the panel 142 from its closed position as illustrated in the solid lines of FIG. 9, to its open position as illustrated in the phantom lines of FIG. 9 to thereby retrieve the toy food articles from the receiving chamber 18. For this purpose, the panel 142 may be provided at its upper end with a integrally formed, slightly upwardly struck locking tab 148 which will permit the releasable locking of the panel 142 in its closed position.

Many of the components forming part of the toy animal figure apparatus of the present invention can be formed of a number of known plastic materials. Thus, for example, these plastic materials may include polyethylene, polystyrene, polybutadiene, various vinylidene copolymers and the like. There may be components formed in a number of known plastic molding operations, as for example, thermo-forming, injection molding, or the like. In addition, for purposes of increased strength and durability, many of the components could be formed of reinforced plastic materials including, for example, fiberglas, boron, carbon and other fibers and grown crystal whiskers incorporated in a suitable matrix, such as an expoy resin or other thermo-plastic or thermo-setting resin. Notwithstanding, many of the components of the apparatus could be formed of other known materials, such as metals, or the like.

As indicated previously, another form of drive mechanism may be substituted for the drive mechanism 48. In this particular case, the drive mechanism 48 will include at least the cup-shaped portion 58 on the tail 22, the ratchet wheel 50, the pawl 68, and the drive roller 82. Thus, a suitable battery operated motor or otherwise a spring operated motor could be used in order to drive the conveyor belt 46. In like manner, another appendage on the body could be actuated in order to rotate the ratchet wheel 50. Thus, for example, one of the legs 12 could be provided with a section to engage and cause rotation of the ratchet wheel 50. The conveyor belt 46 may be replaced by two or more conveyor belts which are operatively connected to operate together in order to create the desired action. In addition, it could be observed that a portion of the conveyor belt could be substituted by a shiftable rack mechanism.

The toy animal figure apparatus A is also provided with a sound-generating mechanism 150 located on the opposite side of the body 10 with respect to the panel 142. In this case, the sound-generating mechanism 150 would be located with respect to a non-openable side pack 152. The sound-generating mechanism is generally conventional in its construction and would be operable to generate a sound characteristic of the animal being represented. Thus, in the case of a goat, the sound-generating mechanism would be operable to produce a sound similar to that of a live goat. Again, the sound-generating mechanism could be operatively coupled to the conveyor belt to the operable thereby. In this way, the goat could generate the typical "goat" sound during the process of taking in the food articles, which depicts an eating action. Otherwise, the sound-generating mechanism could be operatively coupled to the head section 24 in order to generate sound when the head is raised or lowered.

Thus, there has been illustrated and described a unique and novel toy animal figure apparatus in which a plurality of play food articles can be introduced at a mouth opening and conveyed to the interior thereof for later retrieval, and which therefore fulfills all of the objects and advantages sought therefor. It should be understood that many changes, modifications, variations, and other uses and applications of the toy animal figure apparatus will become apparent to those skilled in the art after considering this specification and the accompanying drawings. Therefore, any and all such changes, modifications, variations and other uses and applications which do not depart from the nature and spirit of the invention are deemed to be covered by the invention which is limited only by the following claims.

Having thus described our invention, what is desired to claim and secure by Letters Patent is:

1. A toy animal figure apparatus capable of taking in simulated food articles in a manner simulating the eating of such articles, said apparatus comprising:

(a) a body section, (b) a head portion on said body section and an opening representative of a mouth on said head portion, (c) endless movable conveyor means adapted for continuous movement in one direction in a continuous path during operation for mechanically conveying solid or relatively solid toy food articles of various sizes and shapes which are introduced at said mouth and through the head section, thereby simulating the eating of the articles by said animal figure apparatus, and (d) manually operable actuating means on said animal figure apparatus to cause movement of said conveying means and the conveying of the articles from said mouth and through said head section, said head portion being pivotally mounted on a forward end of said body section and being capable of shifting between an upper position and a lower position so that a portion of that path of movement of the articles may be upward or partially upward, and where said head can be stationarily maintained in the upper position or the lower position or maintained in at least one selected stationary position between the upper and lower positions during the conveying of the food articles, said apparatus also including a jaw portion pivotally mounted on said head portion, and means operatively connected to said conveyor means and said jaw portion to cause a shiftable movement of said jaw portion to simulate a chewing action.

2. The toy animal figure apparatus of claim 1 further characterized in that said conveyor means conveys said articles from said mouth to an interior chamber in said animal body section.

3. The toy animal figure apparatus of claim 2 further characherized in that openable means is located on said body and communicating with the interior chamber in said animal body section to enable a user of the toy animal figure apparatus to remove the articles therefrom.

4. The toy animal figure apparatus of claim 1 further characterized in that said manually operable actuating means is operatively connected to said conveyor means so as to cause movement of said conveyor means in response to movement of said actuating means.

5. The toy animal figure apparatus of claim 4 further characterized in that said actuating means comprises an appendage on said animal figure apparatus which is manually shiftable to cause operation of said conveyor means.

* * * * *